US006772975B2

(12) United States Patent
Sommerfeld et al.

(10) Patent No.: US 6,772,975 B2
(45) Date of Patent: Aug. 10, 2004

(54) TALKING TOILET PAPER ROLL HOLDER

(75) Inventors: Anita J. Sommerfeld, Oak Forest, IL (US); Richard D. Cray, Bolingbrook, IL (US)

(73) Assignee: CCCS, Inc., Elmhurst, IL (US)

( * ) Notice: Subject to any disclaimer, the term of this patent is extended or adjusted under 35 U.S.C. 154(b) by 0 days.

(21) Appl. No.: 10/188,121

(22) Filed: Jul. 3, 2002

(65) Prior Publication Data

US 2004/0004154 A1 Jan. 8, 2004

(51) Int. Cl.[7] ..... G08B 13/14

(52) U.S. Cl. ..... 242/563.2; 242/563; 242/599; 242/912

(58) Field of Search ..... 242/563, 563.2, 242/598, 599, 599.4, 912, 905

(56) References Cited

U.S. PATENT DOCUMENTS

| | | | | | |
|---|---|---|---|---|---|
| 3,037,415 | A | * | 6/1962 | Wyant | 84/95.2 |
| 3,347,480 | A | * | 10/1967 | Abramoff | 225/1 |
| 3,601,328 | A | * | 8/1971 | McClung | 242/599 |
| 4,204,180 | A | * | 5/1980 | Usui et al. | 335/205 |
| 4,422,402 | A | * | 12/1983 | Ogihara | 116/67 A |
| 4,620,184 | A | * | 10/1986 | Nedstedt | 340/675 |
| 4,882,568 | A | * | 11/1989 | Kyser et al. | 340/675 |
| 4,901,663 | A | * | 2/1990 | De Luca | 116/200 |
| 6,000,658 | A | * | 12/1999 | McCall, Jr. | 242/599 |
| 6,082,017 | A | * | 7/2000 | Simar | 33/755 |
| 6,135,384 | A | * | 10/2000 | Skelly et al. | 242/563 |
| 6,367,734 | B1 | * | 4/2002 | Cartwright | 242/599.1 |
| 6,628,789 | B1 | * | 9/2003 | Colby | 381/79 |
| 6,688,551 | B1 | * | 2/2004 | He et al. | 242/599 |
| 2002/0113162 | A1 | * | 8/2002 | Fournier et al. | 242/563.2 |

FOREIGN PATENT DOCUMENTS

| | | | |
|---|---|---|---|
| GB | 2159494 | A | * 12/1985 |
| JP | 356028154 | A | * 3/1981 |

* cited by examiner

*Primary Examiner*—Kathy Matecki
*Assistant Examiner*—Evan Langdon
(74) *Attorney, Agent, or Firm*—James Ray & Associates

(57) ABSTRACT

A talking toilet paper roll holder comprises an elongated housing member and an elongated spring loaded shaft member having a longitudinal axis disposed of along a longitudinal axis of the elongated housing member. Each end of the elongated spring loaded shaft member is adapted for engagement with a wall mounted housing member for such holder. There is further a battery operated talking device disposed on the inside of the housing member at a predetermined location and a switch disposed on the talking device in a position to be engaged by a spring loaded switch activation means that is carried on the shaft member. The activation means engages an outer edge of a full roll of toilet paper that is carried by the holder and is moved inwardly to an on position when toilet paper has been emptied. At least one sound transfer hole is disposed through at least one end of the elongated housing member.

18 Claims, 3 Drawing Sheets

TALKING TOILET PAPER ROLL HOLDER

FIELD OF THE INVENTION

The present invention relates, in general, to toilet paper roll holders and, more particularly, this invention relates to a talking toilet paper roll holder to inform the user of the toilet paper that the roll is empty.

BACKGROUND OF THE INVENTION

Prior to the present invention, as is generally well known in the art, toilet paper roll holders have been in widespread use for many years. As the toilet tissue is dispensed from the roll and the roll becomes completely empty there is no mechanism other than visual to indicate to the user of such paper that the roll has been emptied.

This condition can be particularly distressful to persons who may be blind and/or visually impaired because they would not be aware that such toilet paper roll had been emptied of paper.

SUMMARY OF THE INVENTION

The present invention provides a talking toilet paper roll holder. The talking toilet paper roll holder comprises an elongated housing member and an elongated spring loaded shaft member having a longitudinal axis disposed of along a longitudinal axis of the elongated housing member. Each end of the elongated spring loaded shaft member adapted for engagement with a wall mounted housing member for such toilet paper roll holder.

There is further a battery operated talking device disposed on the inside of the elongated housing member at a predetermined location and a switch disposed on the talking device in a position to be engaged by a spring loaded switch activation means that is carried on the elongated spring loaded shaft member. The spring loaded switch activation means engages an outer edge of a full roll of toilet paper that is carried by the talking toilet paper roll holder and is moved inwardly to an on position when toilet paper has been emptied. At least one sound transfer hole is disposed through at least one end of the elongated housing member.

OBJECTS OF THE INVENTION

It is, therefore, one of the primary objects of the present invention to provide a talking toilet paper holder which will indicate to the user of such toilet paper that the roll has been emptied.

Another object of the present invention is to provide a talking toilet paper roll holder which can be retrofitted onto existing toilet paper roll holders.

Still another object of the present invention is to provide a talking toilet paper roll holder which is relatively simple to use.

Yet another object of the present invention is to provide a talking toilet paper roll holder which can use various saying's or phrases.

Another object of the present invention is to provide a talking toilet paper roll holder which is relatively inexpensive to manufacture.

In addition to the various objects and advantages of the present invention which been described in some detail above is should be obvious that various other objects and advantages of the present invention will become more readily apparent to those persons who are skilled in the relevant art from the following more detailed description of the invention, particularly, when such description is taken in conjunction with the attached drawing figures and with the appended claims.

BRIEF DESCRIPTION OF THE DRAWING FIGURES

BRIEF DESCRIPTION OF A PRESENTLY PREFERRED EMBODIMENT OF THE INVENTION

Figure 1:
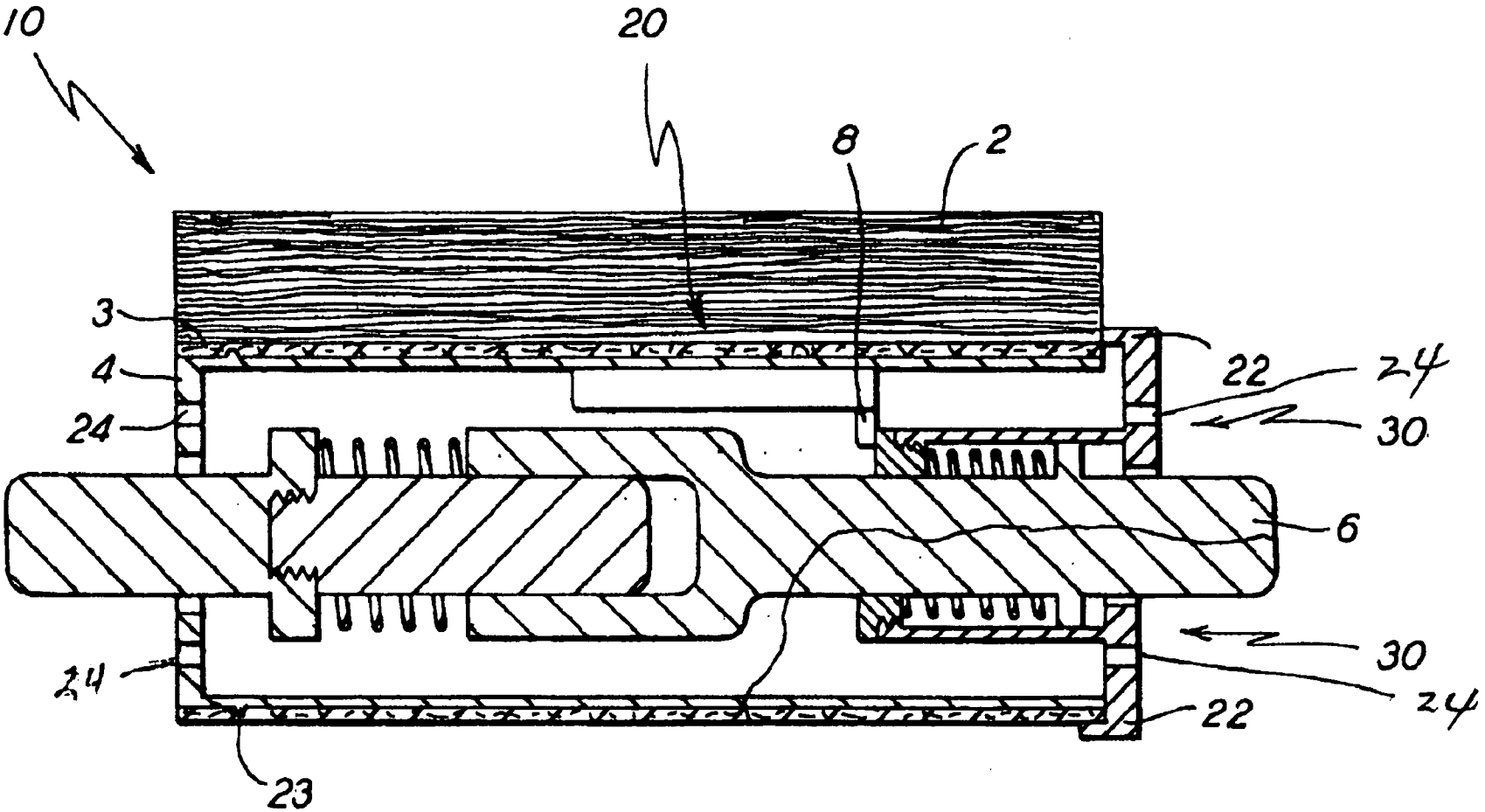
FIG. 1 is a side elevation view partially in cross-section, the upper part of FIG. 1 shows the toilet paper roll holder having unused paper still on the roll and the lower portion of FIG. 1 shows the toilet paper roll holder when the roll is empty.

Reference is now made to FIG. 1. Illustrated therein is an embodiment of the invention in which there is a talking toilet paper roll holder, generally designated 10. Such talking toilet paper roll holder 10 holds a conventional roll of toilet paper 2, that is disposed on a cardboard tube 3. The holder 10 further includes an elongated housing member 4 and an elongated spring loaded shaft member 6.

The spring loaded shaft member has a longitudinal axis that is disposed along a longitudinal axis of the elongated housing member 4. Each of the ends of the elongated spring loaded shaft member 6 are adapted for engagement with a wall mounted housing member (not shown) for holding such toilet paper roll holder 10.

There is further a battery operated talking device, generally designated 20, that is disposed on the inside of the elongated housing member 4 at a predetermined location. The talking toilet paper roll holder 10 further includes a switch 8 disposed on the talking device 20 in a position to be engaged by a spring loaded switch activation means, generally designated 30. The spring loaded switch activation means 30 is carried on the elongated spring loaded shaft member 4.

The spring loaded switch activation means 30 has a portion 22 which engages and outer edge of a full roll of toilet paper 2 that is carried by the talking toilet paper roll holder 10. While toilet paper 2 is present as is seen in the upper half of FIG. 1 portion 22 is held out and is in the off position. When toilet paper 2 has been used up as is seen in the lower half of FIG. 1 then portion 22 of the spring loaded switch activation means 30 moves inwardly and is in the on position and the switch 8 which activates the talking device 20 is energized and the talking device 20 will emit a voice message relaying that the toilet paper 2 is used up. The message can be a saying, a phrase or whatever is desired.

There is also at least one sound transfer hole 24 disposed through at least one end of the elongated housing member. In a presently preferred embodiment of the invention there are more than 1 sound transfer holes 24 in the talking toilet paper roll holder 10.

Such talking toilet paper roll holder 10 further includes a detent 23 to hold the toilet paper roll on the holder 10.

Figure 2:
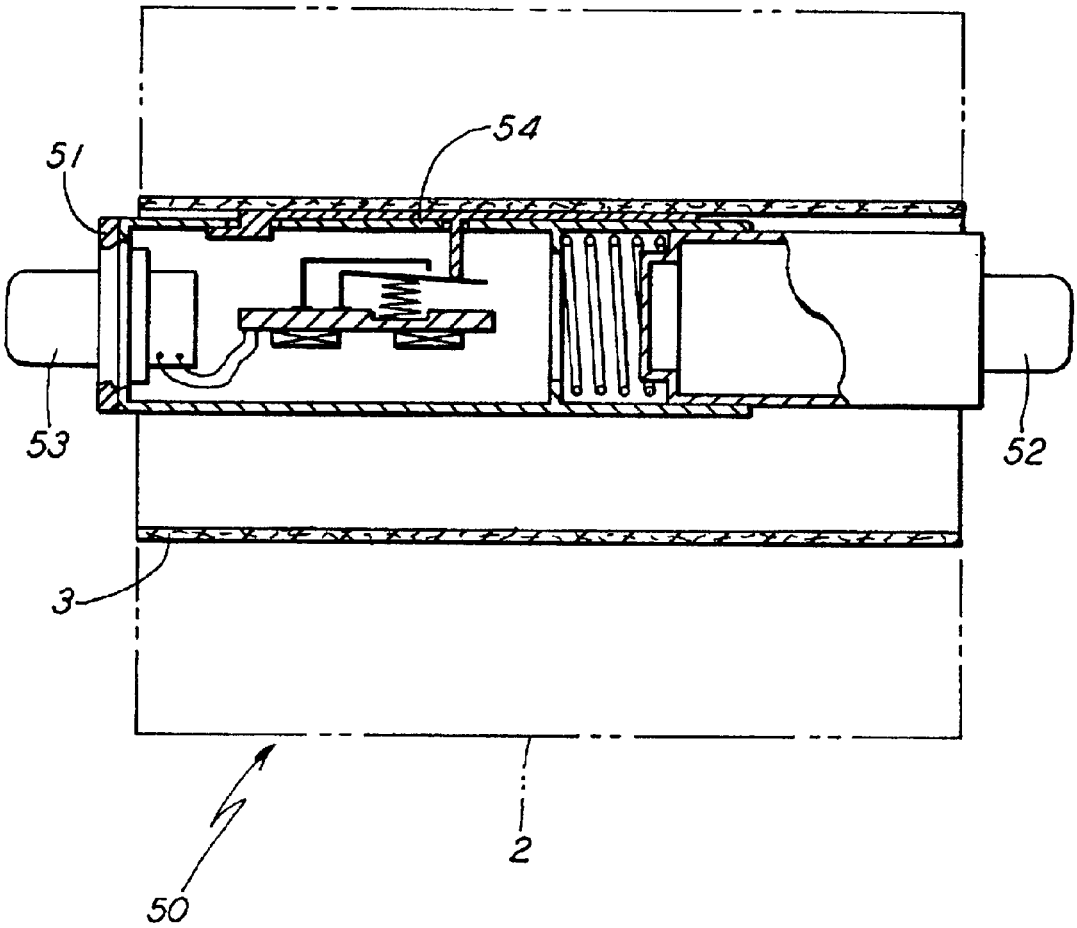
FIG. 2 is a side elevation view of an alternate embodiment of the invention.
Figure 3:
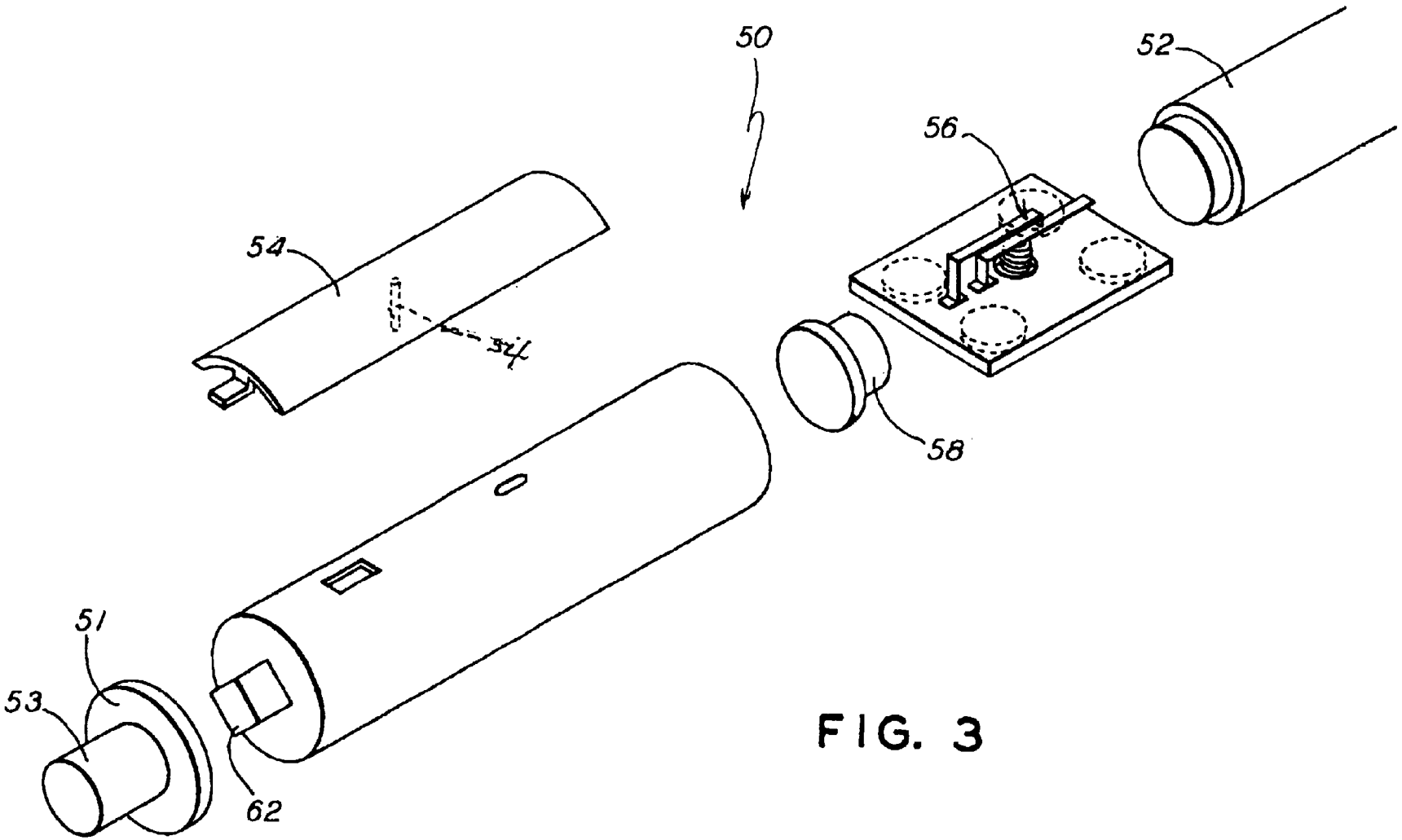
FIG. 3 is an exploded view of the alternate embodiment of the invention shown in FIG. 2.

Reference is now made to FIGS. 2 and 3. Illustrated therein is an alternate embodiment of the invention. In this embodiment the talking toilet paper roll holder, generally designated 50, holds a conventional toilet paper roll 2 that is disposed on a cardboard tube 3. Such talking toilet paper roll holder 50 has a spring loaded elongated housing member 52 with an end cap 51 having a projection 53 at each end adapted for engagement with a wall mounted housing member (not shown) for holding such toilet paper roll holder 50.

A lever portion 54 is disposed on an upper surface of such elongated housing member 52. The weight of such toilet paper 2 pushes the lever portion 54 down which breaks the contact of the activation switch 56 keeping the talking toilet paper roll holder 50 from talking. When the toilet paper 2 is used up and there is insufficient weight to force lever portion 54 down then activation switch 56 is activated and makes contact which energizes the speaker 58 and a message is emitted.

The projection 53 disposed on each end of the elongated housing member 52 has a square aperture on at least one end which engages a square projection 62 disposed on the elongated housing member 52. The square projection 62 by engaging the square aperture on projection 53 prevents the elongated housing member 52 from spinning and thus always keeps the lever portion 54 in position.

While both the presently preferred and a number of alternative embodiments of the present invention have been described in detail above it should be understood that various other adaptations and modifications of the present invention can be envisioned by those persons who are skilled in the relevant art without departing from either the spirit of the invention or the scope of the appended claims.

We claim:

1. A talking toilet paper roll holder, said talking toilet paper roll holder comprising:

(a) an elongated housing member for holding such toilet paper roll;

(b) an elongated spring loaded shaft member, having a spring disposed within and having a longitudinal axis disposed within said elongated housing member along a longitudinal axis of said elongated housing member, each of said elongated spring loaded shaft member adapted for engagement with a wall mounted housing member for said talking toilet paper roll holder;

(c) a battery operated talking device disposed on the inside of said the elongated housing member at a predetermined location;

(d) a switch disposed on said talking device in a position to be engaged by a spring loaded switch activation means carried on said elongated spring loaded shaft member, said spring loaded switch activation means engaging an outer edge of a full roll of toilet paper carried by said talking toilet paper roll holder and being moved in to an on position when such toilet paper has been emptied; and (e) at least one sound transfer hole disposed through at least one end of said elongated housing member.

2. A talking toilet paper roll holder, according to claim 1, wherein said elongated housing member further includes a detent to hold such toilet paper roll on said talking toilet paper roll holder.

3. A talking toilet paper roll holder, according to claim 1, wherein there are at least two sound transfer holes.

4. A talking toilet paper roll holder, according to claim 3, wherein said at least two sound transfer holes are disposed through one end of said elongated housing member.

5. A talking toilet paper roll holder, according to claim 1, wherein said battery operated talking device gives out a message that such toilet paper roll is out of paper.

6. A talking toilet paper roll holder, according to claim 1, wherein said battery operated talking device gives out a message which is one of a phrase and a saying.

7. A talking toilet paper roll holder, according to claim 1, wherein a springs in said spring loaded activation means is one of a compression spring and a tension spring.

8. A talking toilet paper roll holder, according to claim 1, wherein a spring in said elongated spring loaded shaft member is a compression spring.

9. A talking toilet paper roll holder, according to claim 1, wherein said at least one sound transfer hole is disposed through one end of said elongated housing member.

10. A talking toilet paper roll holder, according to claim 3, wherein said at least two sound transfer holes are disposed through said each end of said elongated housing member.

11. A talking toilet paper roll holder, according to claim 7, wherein said spring in said spring loaded activation means is a compression spring.

12. A talking toilet paper roll holder, said talking toilet paper roll holder comprising:

(a) a spring loaded elongated shaft member, having a spring disposed within, for engagement with a wall mounted housing member for said talking toilet paper roll holder;

(b) a battery operated talking device disposed on an inside of said elongated spring loaded housing member, at a predetermined location;

c) a switch disposed on said talking device in a position to be engaged by a switch activation means carried on said elongated spring loaded housing member, said switch activation means engaging a cardboard roll portion of a roll of toilet paper carried by said talking toilet paper roll holder and being moved outwardly to an on position when such toilet paper on such toilet paper roll has been emptied;

(d) a means for preventing said spring loaded elongated housing member from turning and thereby keeping said switch activation means positioned on an upper portion of said spring loaded elongated housing member; and (e) at least one sound transfer hole disposed through at least one end of said spring loaded elongated housing member.

13. A talking toilet paper roll holder, according to claim 12, wherein said switch activation means carried on said elongated spring loaded housing member is a lever member.

14. A talking toilet paper roll holder, according to claim 13, wherein said lever member includes a projection for contacting said switch on said battery operated talking device.

15. A talking toilet paper roll holder, according to claim 12, wherein said means for preventing said spring loaded elongated housing member from turning includes an end cap disposed on at least one end of said spring loaded elongated housing member.

16. A talking toilet paper roll holder, according to claim 15, wherein said end cap disposed on at least one end of said spring loaded elongated housing member further includes at least one projection for engagement with such wall mounted housing member.

17. A talking toilet paper roll holder, according to claim 16, wherein said at least one projection disposed on said end cap further includes a square aperture.

18. A talking toilet paper roll holder, according to claim 17, wherein said means for preventing said spring loaded elongated housing member from turning further includes a square projection on at least one end of said spring loaded elongated housing member for engagement with said square aperture disposed on said end cap.

* * * * *